United States Patent [19]

Uhlig

[11] 3,949,893

[45] Apr. 13, 1976

[54] SAFETY CLOSURE CONTAINER

[76] Inventor: Gerhardt E. Uhlig, 1900 Alexis Road, Apt. L-201, Toledo, Ohio 43613

[22] Filed: Aug. 19, 1974

[21] Appl. No.: 498,588

[52] U.S. Cl. ..... 215/216

[51] Int. Cl.[2]. B65D 55/02; B65D 85/56; A61J 1/00

[58] Field of Search..... 215/9, 216, 214

[56] References Cited

UNITED STATES PATENTS

| | | | |
|---|---|---|---|
| 3,435,975 | 4/1969 | Weigand | 215/214 |
| 3,770,153 | 11/1973 | Gach et al. | 215/9 |
| 3,826,395 | 7/1974 | Montgomery | 215/9 |
| 3,841,514 | 10/1974 | Montgomery et al. | 215/9 |

*Primary Examiner*—George T. Hall
*Attorney, Agent, or Firm*—Paul F. Stutz

[57] ABSTRACT

A novel container/closure construction including unique safety locking arrangements in the form of registering abutments and projections formed in and/or on said container and/or closure which do not substantially interfere with the application of the closure to the container but which can be disengaged only through purposeful, mind-controlled, dextrous manipulation including deflection of the closure. A threaded coupling of the container and closure is provided in preferred embodiments.

5 Claims, 11 Drawing Figures

SAFETY CLOSURE CONTAINER

This application discloses and claims subject matter previously disclosed, at least in part, in my copending applications Ser. No. 491,534, filed July 24, 1974; now Patent 3,917,097, and Ser. No. 475,593, filed June 3, 1974, and which is a division of Ser. No. 288,129, filed Sept. 11, 1972, now U.S. Pat. No. 3,830,391, issued Aug. 20, 1974, which application 288,129 is a continuation of application Ser. No. 16,427, filed Mar. 4, 1970, now abandoned.

The present application contemplates a combination of a novel container and novel cooperating closure structure serving as a receptacle for any variety of what may be referred to as sensitive products desirably contained, but safely contained, out of reach or in a manner inaccessible to children of tender years or others of impaired mental faculties or possessed of any variety of disabilities as might be harmed by the contents.

The sensitive products include, but are not limited to, liquid or solid medicines, pills, prescriptions, treatments and, as well, soaps, detergents, pesticides, poisons, solvents, industrial chemicals and the like; any one of which sensitive products could be harmful to the person of the unknowning user, either externally applied or taken internally.

The container industry, the closure industry and, as well, other industries engaged in the manufacture and sale of sensitive products of the type disclosed above have been for some time engaged in a search for and the development of a package, such as a container and closure combination or variant thereof, which would embody constructional features which would preclude accidental or easy opening of the package containing the particular sensitive product. Considerable efforts have been expended, albeit without arriving at a package which is universally acceptable by the variety of manufacturers for the variety of sensitive products for which such a package has utility. While a number of packages have been developed and/or described in the patent literature, a principal objection to the presently existing ones resides in the excessive cost of manufacture, usually due to the multiple parts involved, the complexity of design, the unattractiveness and either being too easily or overly difficult in opening.

Patented packages include those disclosed in the following list: U.S. Pat. Nos. Steiner 3,399,796; Schaefer 3,360,147; Quackenbush 3,422,978; Deaver 3,376,991; Weigand 3,435,974; Cilluffo 3,445,022 and Whiteman, Jr. 3,101,856.

A particularly notorious situation is involved in the packaging of sensitive products which are poisonous to a particular segment of the population such as children or to certain children or infirmed, handicapped or disabled adults who might be susceptible to a given drug and/or product. Aspirin is exemplary of the largest single culprit in child poisonings.

Another problem which exists with respect to present child-deterrent safety packages resides in the fact that they are not liquid-tight. Furthermore, some of the closure/package combinations, while frustrating to children and thus constituting a partial solution to the problem, are also difficult to open for adults. Still other closure arrangements require that the container be inverted before disengagement of the safety lock feature. This, of course, can be particularly and significantly messy with certain liquids. It can also be dangerous with certain liquids. It is also known, as previously indicated, that some of the present caps on the market, allegedly designed to prevent child entry, are composed of two or more pieces with attendant disadvantages in manufacture and, of course, cost.

With the foregoing brief introduction, it is a general object of the present invention to provide a combination of closure and container which embodies features of construction which permit the manufacture of a child-deterrent package which is avoidative of the problems presently demonstrated by packages on the market or described in known patents and at the same time embodies a signifiant number of advantages and unique features which are believed nowhere to be found in any of the existing packages or patents in use or of record.

It is a particular object of the present invention to provide a combination of container and closure which embodies a safety lock feature which frustrates opening by a child but is relatively easily opened by a person exercising a purposeful, intelligent, cooperative, dextrous, mind-hand opening effort.

It is a significant object of the present invention to provide such a combination of container and closure which embodies a screw thread principal closure arrangement whereby the package is eminently suitable for fluid-tight closure, thus making the package eminently suitable for the containing of liquid products.

It is still another object of the present invention to provide such a container and closure combination which, upon operative engagement of the safety lock feature, provides an audible noise, thereby satisfying the one applying the closure to the container that the device is in the fully closed and safe position.

It is yet another object of the present invention to provide a container and closure combination which is capable of manufacture with conventional equipment used in the manufacture of containers, both glass and plastic, including the conventional plastic closure-making machinery, without any substantially burdensome modifications, whereby any cost factor, as compared to a conventional container and closure device not embodying a safety lock or a child-deterrent feature, is not excessive or even significant. Conventional plastic molding techniques are, of course, usable without difficulty.

It is still another object of the present invention to provide such a container and closure combination which, by reason of the design of the component parts, is capable of being easily assembled together by the user or packer utilizing conventional capping machines normally employed following the product filling line.

It is a significant object of the present invention to provide a package which embodies the child-deterrent safety lock feature which is reliable and long lasting even after repeated cycles of opening and closing by successive users.

It is a particular object of the present invention to provide a combination of closure and container which embodies a resilient and consequently deformable segment of either the container or the closure to permit a purposeful disengagement of the locked-together engagement means as to permit opening of the container by one capable of performing the act of purposeful deflection to accomplish said disengagement while at the same time precluding accidental disengagement and opening of the container and/or closure. Hand in hand with the present object and desirably in combination therewith, it is most preferable that the principal securement of the container and the closure be accomplished utilizing the screw thread type of engagement.

In accordance with a further embodiment of the present invention, it is possible and frequently desirable to design the location of the projections and the inner wall or web in such a manner that the engagement thereof is accomplished at precisely the same time that the underside of the descending cap, as provided by engagement of the screw threads, assumes sealing engagement with the upper rim of the neck of the container. The safety lock feature being thus engaged will preclude any accidental loosening of the closure from the container neck as might otherwise occur by reason of the space between the projection and the recess as present in the embodiments illustrated and by reason of the tendency of some plastics to experience the phenomena of "cap creeping". The latter is especially associated with polyethylene.

It is a significant object of the present invention to provide the closure component of the present invention as a one-piece relatively thin wall design susceptible to efficient and economical molding in large quantities without unduly complicated or expensive molds, albeit possessed of unique features of construction which, in cooperative conjunction with novel yet simple constructional features of the container, provide the functional package of the present invention.

It is yet another object of the present invention to provide a closure/container construction inclusive of the features of novelty as hereinbefore discussed and additionally of such novel design that the locking features are hidden from view such that inspection of the casual observer finds no evidence to speak of as to their existence.

The foregoing, as well as other objects of the present invention, will become apparent to those skilled in the art from the following detailed description taken in conjunction with the annexed sheets of drawings on which there are presented, for purposes of illustration only, several embodiments of the present invention.

IN THE DRAWINGS

Figure 1:
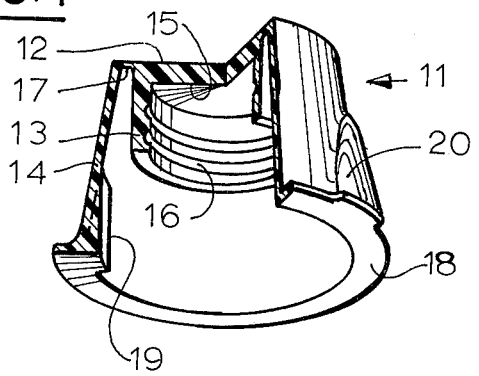
FIG. 1 is a perspective view of a closure member in accordance with one embodiment of the present invention; a segment of the closure being shown cutaway in order to show the interior structure.

Considered most basically, the packages, e.g., container/closure structures in accordance with the present invention, comprise:

1. one embodiment in which the container has designedly and conveniently located on its shoulder region an abutment engageable with a similar abutment preselectively radially located interiorly of a depending closure skirt portion of a closure sealingly engageable with said container, said closure skirt being purposefully laterally deflectable for disengagement of said respective container and closure abutments but normally in the closed relationship, precluding accidental or nonpurposeful removal of the closure; or
2. a second embodiment in which a container has one or two abutments formed on an annular strip-like beveled surface extending about the shoulder region of said container and a closure having matching, preselectively located abutments formed on the interior surface of a downwardly deflectable skirt, said closure abutment having lower beveled surfaces normally resting on said strip-like beveled surface on said container shoulder, said respective abutments on said container and closure normally precluding accidental removal of the closure but said closure skirt being constructed for downward deflection, causing said beveled closure abutments to slide downwardly on said container bevel to disengage said respective abutments responsive to mind-controlled, purposeful and dextrous downward manipulation of the closure skirt, permitting thereby disassemblement of the closure from the container by reason of the nonabutment of said respective abutments whereby access can be had to the interior of the container.

In order to provide for fluid-sealed closure relationship of the closure with the container in the above embodiments, it is most preferred that the container and closure each include cooperating closure threads to effect rotational engagement and fluid-sealed contact between the closure and the container. Most preferably, the thread pitch and abutment location are preselectively designed and located to provide coincident registration whereby locking engagement and sealing engagement is substantially simultaneously achieved as the closure is rotated onto the container via said cooperating threads or threaded engagement. The designed location and pitch of the threads in connection with the abutments, both on the container and on the closure, are referred to as coincident registration as described in prior copending applications.

It is an important feature of the present invention that one holding the package consisting of the container and the closure will not, with normal hand manipulation of a casual nature or using a conventional unscrewing motion, be able to open the container by removal of the closure. To the contrary, the one holding the package will, of necessity, be required to perceive and comprehend instructions or visible indicia contained on or attached to the package before he can successfully and purposefully manipulate the package or some component thereof whereby the safety lock feature is disengaged, permitting further opening of the package to gain access to the interior of the container and, of course, whatever it contains. The instructions may be in the form of printed instructions on a label affixed to the container, the closure or the carton containing the package. The instructions may also be imprinted into the container or take the form of arrows or thumb and/or finger spots of indentations.

The package consisting of specially designed container and closure in accordance with the present invention may feature instructions in the form of color coding, a numeral indexing or any variety or combination of key-guided manipulation of the package. At the same time, it must be noted that once the key or code is known, appropriate dextrous manipulation of the package is easily accomplished, permitting purposeful, intelligent access to the contents, but at the same time precluding access to the contents by one not capable of perceiving or appreciating the instructions, the key coding, the indicia or the like.

It is appreciated that even one of very tender years quickly learns how to unscrew a cap from, for example, an aspirin bottle. Experience and observation establish that a person faced with a package embodying the features of construction in accordance with the present invention will be unable to open the package. Furthermore, the initial failure quickly discourages any further attempts, whereby the contents are not exposed or made available, particularly to the child of tender years.

It is a significant feature of the container/closure combination of the present invention that the combination is particularly useful in the packaging of liquid products providing a completely leak-proof closure, albeit embodying a safety lock, precluding accidental disengagement of the safety lock feature. A significant feature resides in the fact that the safety lock becomes operative while the closure is being applied; that is, screwed onto the neck of the container. Thus, at a given point of screw application of the cap or closure, the safety lock feature becomes operative and the cap can no longer be simply unscrewed. On the other hand, the cap can be continued to be tightened onto the neck portion whereby the top wall achieves sealing engagement with the upper circular rim of the container, thereby completely sealing the container. It will be appreciated that appropriate gaskets and plastic inner liners of various sorts may optionally be used on the underside of the closure cap or top wall thereof to increase the sealing efficiency due to the resilient or deformable character of the liner, gasket or plastic seal ring, etc.

The exact nature of the construction of the present invention will become more readily apparent by detailed examination of the drawings and the following description in which the component parts and segments of the closure and container will be identified by appropriate reference numerals and figure numbers to assist in an understanding of the cooperative relationship of the parts and the appropriate constructional features constituting preferred embodiments of the present invention..

In order to obtain a fuller and more complete understanding of the cooperating closure and container structure of the present invention, reference may be had to FIGS. 1–6 wherein there is illustrated, in the several views, drawings of the closure and container separately and of the closure and container in different stages of engagement in accordance with one embodiment of the present invention.

Referring now more specifically to FIG. 1, the closure 11 includes a top wall 12, an inner depending skirt 13 and an outer depending skirt 14. The top wall includes an underside surface 15 for sealing contact with the container, as described hereinafter. The inner skirt 13 includes thread-like grooves 16 on the inner surface. The outer skirt 14 is connected at the top of the inner skirt 13 and is separated therefrom by a relatively thin annular web 17. The skirt 14 extends flaringly downwardly and outwardly to terminate in a connected, radially extending, relatively rigid, reinforcing flange 18. The outer depending skirt 14 extends downwardly twice the extent of the inner skirt 13. On the inner surface of the skirt 14, there is formed a wedge-like projection 19, hereinafter referred to as an abutment in describing its function. The wedge abutment 19 extends vertically upwardly to merge smoothly into the inner surface of the skirt. Directly opposite the wedge 19, there is formed on the outer surface of the skirt 14 an indentation or finger spot 20.

Figure 2:
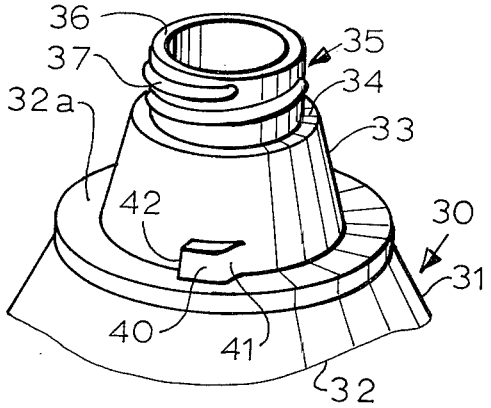
FIG. 2 is a perspective view of the neck, shoulder and mouth regions of a container illustrating constructional features in accordance with the present embodiment and novelty adapted for closure by the closure of FIG. 1.

Referring to FIG. 2, there is seen a container 30 having a hollow body 31 cut away on the line 32 and serving as the receptacle for suitable contents. A horizontal shoulder 32a at the upper region of the body 31 leads to the neck portion 33 which tapers upwardly and inwardly to a smaller shoulder 34 from which projects upwardly a cylindrical finish 35, terminating in a mouth-surrounding rim 36 defining a passageway into the hollow interior of the body. The finish 35 includes, on the outer surface, threads 37 which are complementary to the grooves 16 on the inner surface of skirt 13 of closure 11. The neck 33 has formed thereon, projecting outwardly adjacent just above shoulder 32a, a projection 40 which has one curved cam-like vertical surface 41 and an abrupt edge abutment 42.

Figure 3:
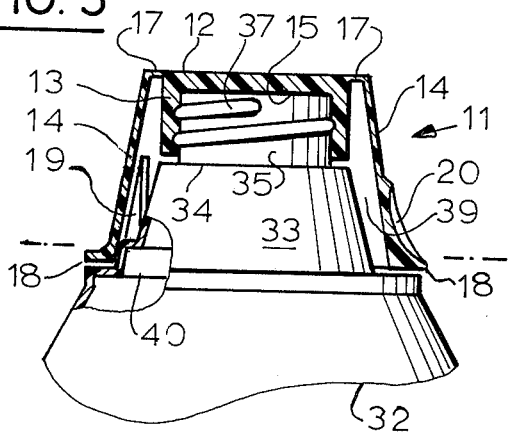
FIG. 3 is a side sectional view of the closure/container taken on the line 3—3 of FIG. 4.
Figure 4:
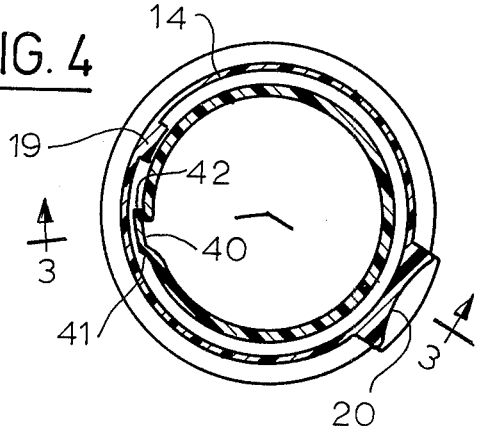
FIG. 4 is a horizontal sectional view of the engaged closure and container, with the closure secured thereto in fluid-sealed, locked relationship.

The closure 11 is applied to the container 30 by simply telescoping the flanged end 18 of skirt 14 about the neck to bring the grooves 16 into engagement with the threads 37 on the neck; following which, clockwise relative movement of the closure will engage the threads and bring the inner surface of the top wall down even closer to the rim 36 of the container. As the outer skirt descends, the wedge-shaped abutment 19 passes smoothly over cam surface 41, permitting continued rotational tightening of the closure until the inner surface 15 begins to seat on the rim 36. By reason of the proper location of the projection 40, in cooperation with the design, pitch and location of the threads 37 and, as well, the matching pitch and design of the threads 16 in positional relationship with the abutment 19, the closure approaches substantially sealing relationship just as the abutment 19 passes over the projection 40, leaving room for still a few degrees more of turning until the parts are in the relative position as illustrated in FIG. 4 and, as well, FIG. 3. As can be seen in FIG. 3, the inner surface 15 of wall 12 is flush against the rim 36, leaving no space, contrary to the slight space in FIG. 5. Also, the wedge 19 is now clockwise a few degrees past the projecton 40.

To disengage the closure, a counterclockwise movement of the closure will bring the abutment 19 into contact with edge 42 of projection 40 whereby the closure assumes the position shown in FIG. 3 but, without anything more, continued counterclockwise rotation is impossible.

Figure 5:
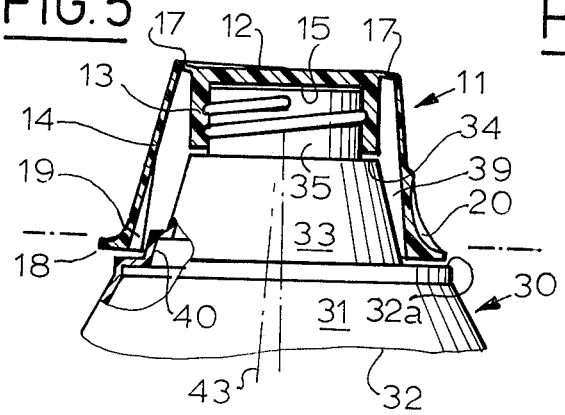
FIG. 5 is a side sectional view of the same closure/container taken on the line 5—5 of FIG. 6, with the closure and container shown in relative position for unlocking the safety lock feature.
Figure 6:
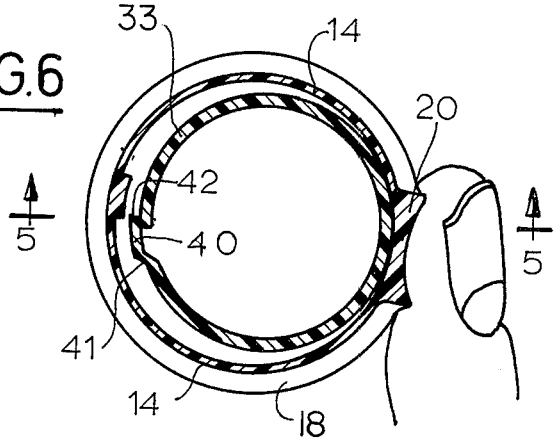
FIG. 6 is a horizontal sectional view like FIG. 4 but with the closure/container in different relationship for disengagement.

The disengagement of the abutments is achieved by pressing a finger or thumb against the indentation or thumb spot 20 in the manner illustrated in FIGS. 5 and 6. This lateral pressure, largely due to the relatively rigid, reinforcing flange 18 and further in conjunction with the relative thinness of the depending skirt wall 14 and, as well, the web connector 17, will cause the flange, which is like a hoop, to move laterally outwardly, carrying with it the abutment 19, providing a clearance for passage of the abutments, disengaging the closure and allowing continued counterclockwise rotation and removal of the closure. The inward movement of the hoop skirt is shown in FIGS. 5 and 6 wherein it may be noted that the clearance 39 in FIG. 5 is not as great as in FIG. 3. This clearance is the space between the inner surface of the skirt 14 and the outer surface of the neck 33.

The feature of coincident registration as described in earlier applications permits the closure once locked, by reason of the fact that the abutments have passed in the manner of FIG. 4, to be tightened several additional degrees without inducing any particular stress or strain in any other part of the closure or container.

The inward movement of the skirt 14 by the thumb pressure at spot 20 moves the relatively rigid, reinforcing flange 18 outwardly on the opposite side as aided by the web-like connection 17 between the upper terminus of skirt 14 and the top wall 12. The slight flexing of the web 17 is shown in FIG. 5. See also the inclined centerline in this FIG. 5.

Reference is now directed to FIGS. 7-11 which, in conjunction with the following descriptions, will disclose the nature of a further embodiment of the present invention.

Figure 7:
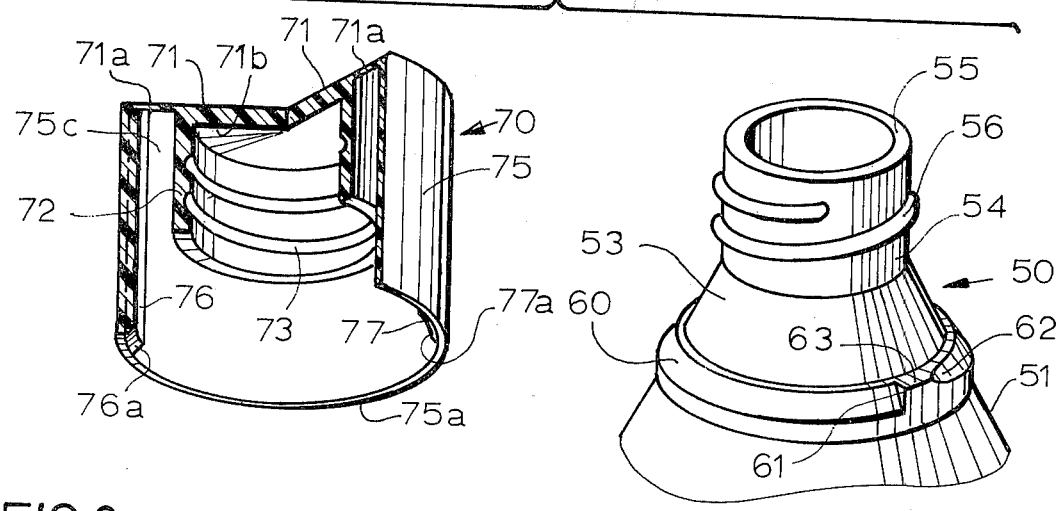
FIG. 7 is a partially sectional perspective view of a container, principally of the neck and mouth regions, and, adjacent thereto, a closure; the two, in combination, illustrating a construction representing an alternative and/or variant embodiment of the present invention.
Figure 8:
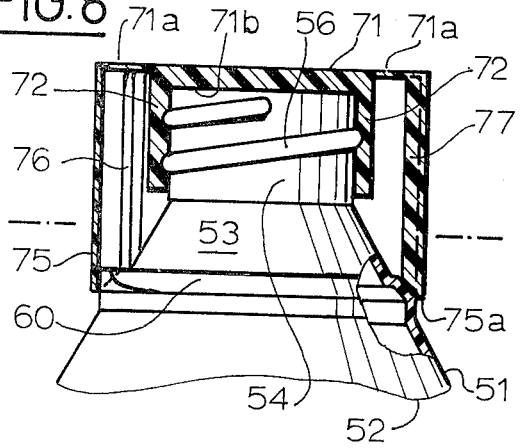
FIG. 8 is a side sectional view of the closure and container in engaged position taken on the line 8—8 of FIG. 9.
Figure 9:
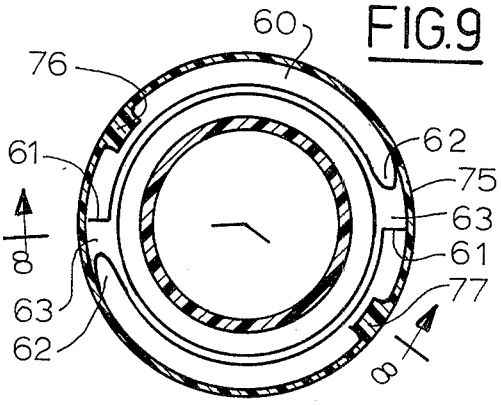
FIG. 9 is a horizontal sectional view of the container and closure in sealed, fully engaged relationship.
Figure 10:
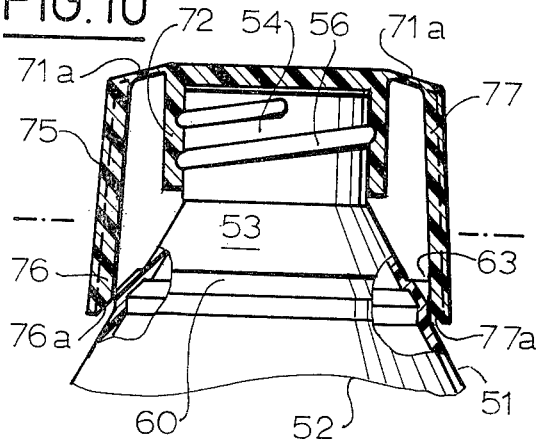
FIG. 10 is a side sectional view similar to FIG. 8 taken on the line 10—10 of FIG. 11; the closure being principally shown in safety unlocked position with respect to the container neck and shoulder.
Figure 11:
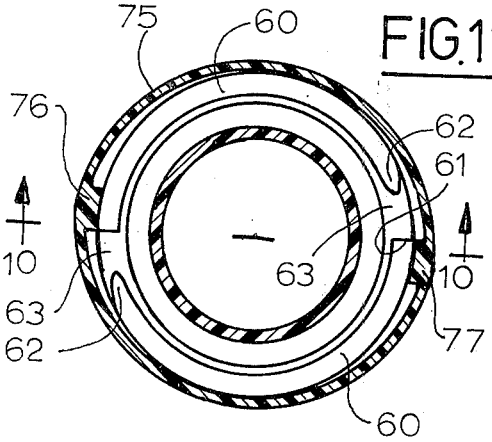
FIG. 11 is a horizontal sectional view similar to that of FIG. 9 but with the closure and container in relatively safety unlocked position.

In FIG. 7, to the right, a container or receptacle identified by the reference numeral 50 includes a lower body portion broken on the line 52; the body portion being hollow and serving as the reservoir for contents. At the upper end of the body, a shoulder connects with a neck region 53 which extends upwardly and inwardly to merge with an upper cylindrical neck or finish 54, terminating in a mouth-surrounding rim 55; the mouth communicating with the interior of the receptacle. A thread 56 is formed on the cylindrical neck 54. The shoulder region between the body 51 and neck 53 inclues a 45° shoulder bevel or cam surface identified by the reference numeral 60. As indicated, the bevel or cam surface is incomplete, extending between two diametrically located normal shoulder regions 63, each having a gradual smooth mergement segment 62 leading to the normal shoulder formations indentified by the reference numeral 63, each of which extends for only about 10° of circumference. Closure 70 on the left of FIG. 7 includes a top wall 71 and a marginal depending inner skirt 72 having, on the inside surface, threaded grooves 73 matching threads 56 in the container neck. The closure additionally includes an outer depending skirt 75 separated by an annular space 75*c* from the inner depending skirt and connected thereto by an annular web 71*a* whose top surface is coextensive with the top surface of the top wall 71. The inside surface of outer skirt 75 includes a pair of inwardly projecting ribs 76 and 77 which extend vertically from the top wall 71 or web 71*a* to the lower edge 75*a*. The lower edges of the ribs 76 and 77 identified by the reference numerals 76*a* and 77*a*, respectively, are chamfered or beveled to match generally the angularity of the bevel surface 60 on the shoulder of the container. The closure is applied to the container neck in the usual manner and, as the closure nears full closed position, the rib projections 76 and 77 slide smoothly past via the cam approaches 62, across the segment 63 and past the abutment edge 61 to the position of FIGS. 8 and 9. Once this position has been reached, a counterclockwise unscrewing of the container will bring the rib abutments 76 and 77 against the edges 61 of the shoulder segments 63. In the position of FIG. 9, the container is fluidly sealed by the closure since there is no space shown between the rim 55 and the underside surface of the top wall identified by the reference numeral 71*b*. Considering the closure as being applied in a clockwise direction, the abutments 76 and 77, as can be seen, are a few degrees clockwise from abutting relationship with the edges 61. This is purposely provided in the closure/container construction of the present invention so that undue stress upon any part of the closure or container is avoided, contrary to ratchet-type locking fasteners. To effect removal of the closure, it is necessary to grasp the outer skirt between thumb and forefinger or entire hand, for example, and exert a downward force on the outer skirt 75 which will cause the lower skirt to move downward as aided and abetted by the sliding contact of the cam surface 76*a* and the cam surface 77*a* on the shoulder bevel 60 and, further, by the flexing of the thin annular web connection 71*a*. In this position, particularly as shown in FIGS. 10 and 11, the closure can be moved in a counterclockwise direction, with the ribs displaced outwardly so they will not contact the edges 61 of segments 63. The counterclockwise rotation, specifically the movement of the rib abutments 76 and 77 past the segment edges 61, is shown in FIG. 11, particularly the deflection of each of the ribs 76 and 77 outwardly.

It will be appreciated that the downward movement of the outer skirt and the deflection at the region of the two ribs cause the regions of the skirt 90° disposed thereto to move inwardly toward beveled collar or shoulder 60 on the container. This is shown in FIG. 11 at the top and bottom thereof wherein it can be seen that the skirt is almost contacting the beveled shoulder 60. Resiliency, of course, is a desirable property of the candidate material employed in molding the closure members in accordance with the present invention.

It will be appreciated that quite a variety of materials may be employed in fabricating the closure and, as well, the container. The container may be formed of metal, glass or any suitable rigid or semi-rigid plastic materials, having in mind the properties and characteristics of the product. The closure should be formed of a relatively flexible material, whereby the depending skirt portions can flex repeatedly as occasioned by repeated openings and closings of the package. It will be appreciated that the particular dimensions in terms of wall thickness, etc., particularly as to the wall members and skirts and the connecting parts, may be varied to meet the properties of the specific plastic material. The latter, of course, may be selected, having in mind perhaps the nature of the contents or the specific environmental conditions to be encountered by the package.

Modifications may be resorted to without departing from the spirit and scope of the appended claims and all such modifications including equivalents are intended to be covered unless such would do violence to the appended claims.

I claim:

1. In combination:

a container including (1) a principal hollow body serving as a receptacle and (2) a connected upstanding neck terminating in a rim-defined opening and having closure attachment means formed on the exterior annular surface of said neck for rotational, releasable engagement by cooperating attachment means formed on a suitable closure, a closure member including (1) a top wall spanning said rim-defined opening, said top wall being adapted to sealingly contact said rim, (2) a connected depending skirt having attachment means formed on the inner surface of said skirt adapted to rotationally, releasably engage said attachment means on said neck of said container, said skirt and container each including a cooperatively engageable and disengageable lock abutment, each abutment located in mutual coincident registration with reference to said attachment means and achievement of said sealing contact, and means for accomplishing purposeful, dextrous, manipulative disengagement of said abutments, said means comprising a lower terminus formed on said skirt, said terminus being relatively more rigid than said skirt proper such that lateral pressure at a point on said terminus, generally diametrically opposite said abutment, will cause lateral deflection of said skirt and disengagement of said lock abutments, whereby rotating disengagement of said attachment means can be initiated.

2. A closure adapted for substantially sealing, removable engagement with a container having (a) a hollow body serving as a receptacle, (b) a connected upstanding neck terminating in a rim-defined opening, (c) a radially generally outwardly projecting stop projection located in the shoulder to neck region of said container and (d) rotational, releasable attachment means formed on said neck, said closure member including (a) a top wall capable of spanning said rim-defined opening and being adapted to sealingly contact said rim, (b) a connected depending inner skirt having attachment means formed on the inner surface thereof for rotational, releasable engagement with said attachment means on the exterior surface of said neck and (c) a second connected depending outer skirt having an inner surface inclusive of a projection extending radially inwardly, said projections on said container and said closure being located in coincident registration with said container and closure attachment means such that rotational engagement of said closure onto said container will bring said respective projection abutments into mutual locking relationship about coincidentally with approaching sealing relationship of said top wall inner surface and said container rim, said outer skirt including a lower terminus constructed and arranged to lend reinforcing rigidity thereto such that finger pressure applied to the lower terminus of said skirt opposite said projection will shift said lower annular edge outwardly to disengage said projection abutments, allowing rotational removal of said closure.

3. In combination, (1) a container including (a) a principal body defining a receptacle for contents, (b) a connected upstanding neck terminating in a rim-defined opening, (c) rotational, releasable closure attachment means formed on the upper exterior surface of said neck and (d) an annular strip-like bevel extending substantially peripherally about said container in the shoulder region, said strip being interrupted by at least one island projecting outwardly from said bevel surface to define, on one side thereof, an abutment edge and, on the other side thereof, a smooth cam edge, and (2) a closure including (a) a top wall spanning said opening, (b) a first inner skirt depending marginally from said top wall, said skirt having rotational, releasable container attachment means formed on the interior surface for rotational, releasable engagement with said attachment means on said container, and (c) a second skirt spaced to encircle said first skirt and connected to said top wall and inner skirt by relatively thin, flexible, annular web, said second skirt including at least one projection extending radially inwardly from said second skirt inner surface, said projection having a lower bevel edge generally matching said surface of said container bevel strip, said projection on said closure, said island and said attachment means being conjointly constructed and arranged so that engagement of said closure on said container will coincide with proximate sealing of said opening by said top wall and with proximate registration of said abutment edge of said island and said projection of said second skirt whereby said closure is locked onto said container and normal rotational movement of said second skirt will cause abutting contact by said parts, said second skirt being manually and purposely movable downwardly through deflection of said connecting web and assisted by sliding movement of said skirt projection level bevel edge against said container shoulder bevel to a position terminating abutment of said closure second skirt projection and said island abutment edge, permitting thereby continued rotational removal of said closure.

4. The combination as claimed in claim 3, wherein said container/closure attachment means comprise grooved threads on the inner surface of said inner skirt and formed threads on the neck of said container and wherein said container shoulder bevel surface is interrupted by two diametrically opposite islands having, on one side, an abutment edge and, on the other side, a cam edge to accommodate rotational movement of said closure skirt projection past said island as said closure is rotationally applied to said container neck.

5. A closure adapted for substantially sealing, removable engagement with a container having (a) a hollow body serving as a receptacle, (b) a connected upstanding neck terminating in a rim-defined opening, (c) a generally radially outwardly projecting stop projection located in the shoulder to neck region of said container and (d) rotational, releasable attachment means formed on said neck, said closure member including (a) a top wall capable of spanning said rim-defined opening and being adapted to sealingly contact said rim, (b) attachment means formed thereon for rotational, releasable engagement with said attachment means on the exterior surface of said neck and (c) a connected, depending, annular skirt having an inner surface terminating in a lower terminus and being inclusive of a projection extending generally radially inwardly, said projection on said container and said projection on said closure being located in coincident registration with reference to said container and closure attachment means such that rotational engagement of said closure onto said container will bring said respective projection abutments into mutual locking relationship about coincidentally with approaching sealing relationship on said top wall inner surface and said container rim, said annular skirt including a lower terminus constructed to lend reinforcing ridigity thereto such that finger pressure applied to the lower terminus of said skirt opposite said projection will shift said lower annular edge outwardly to disengage said projection abutments, allowing rotational removal of said closure.

* * * * *